US012247311B2

(12) United States Patent
Chang et al.

(10) Patent No.: US 12,247,311 B2
(45) Date of Patent: Mar. 11, 2025

(54) PLATING APPARATUS AND PLATING PROCESS METHOD

(71) Applicant: EBARA CORPORATION, Tokyo (JP)

(72) Inventors: Shao Hua Chang, Tokyo (JP); Yasuyuki Masuda, Tokyo (JP); Masaya Seki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 651 days.

(21) Appl. No.: 17/624,034

(22) PCT Filed: Dec. 8, 2020

(86) PCT No.: PCT/JP2020/045625
§ 371 (c)(1),
(2) Date: Dec. 30, 2021

(87) PCT Pub. No.: WO2022/123648
PCT Pub. Date: Jun. 16, 2022

(65) Prior Publication Data

US 2022/0356595 A1 Nov. 10, 2022

(51) Int. Cl.
*C25D 17/00* (2006.01)
*C25D 5/02* (2006.01)
(Continued)

(52) U.S. Cl.
CPC ..... *C25D 17/02* (2013.01); *C25D 5/022* (2013.01); *C25D 17/001* (2013.01);
(Continued)

(58) Field of Classification Search
None
See application file for complete search history.

(56) References Cited

U.S. PATENT DOCUMENTS 6,402,923 B1 * 6/2002 Mayer ..... C25D 17/001 204/297.05
6,821,407 B1 * 11/2004 Reid ..... C25D 17/002 204/252
(Continued)

FOREIGN PATENT DOCUMENTS

JP H07-034252 A 2/1995
JP H11-350185 A 12/1999
(Continued)

*Primary Examiner* — Binu Thomas
(74) *Attorney, Agent, or Firm* — BakerHostetler

(57) ABSTRACT

Provided is a technique that ensures suppressed deterioration of plating quality of a substrate due to a process gas that remains on a lower surface of a membrane.

A plating apparatus 1000 includes a plating tank 10 and a substrate holder 30. The plating tank includes an anode 11 arranged in an anode chamber 13. The substrate holder is arranged above the anode chamber and configured to hold a substrate Wf as a cathode. The anode has a cylindrical shape extending in a vertical direction. The plating apparatus further includes a gas accumulation portion 60 and a discharge mechanism 70. The gas accumulation portion is disposed in the anode chamber so as to have a space between the anode and the gas accumulation portion. The gas accumulation portion covers an upper end, an outer peripheral surface, and an inner peripheral surface of the anode to accumulate a process gas generated from the anode. The discharge mechanism is configured to discharge the process gas accumulated in the gas accumulation portion to outside of the plating tank.

11 Claims, 10 Drawing Sheets

(51) Int. Cl.

| | |
|---|---|
| ***C25D 17/02*** | (2006.01) |
| ***C25D 17/08*** | (2006.01) |
| ***C25D 17/10*** | (2006.01) |
| ***C25D 17/12*** | (2006.01) |
| ***C25D 21/04*** | (2006.01) |
| ***C25D 21/12*** | (2006.01) |
| *C25D 5/04* | (2006.01) |

(52) U.S. Cl.
CPC ..... *C25D 17/002* (2013.01); *C25D 17/008* (2013.01); *C25D 17/08* (2013.01); *C25D 17/10* (2013.01); *C25D 17/12* (2013.01); *C25D 21/04* (2013.01); *C25D 21/12* (2013.01); *C25D 5/04* (2013.01)

(56) References Cited

U.S. PATENT DOCUMENTS

| | | | | |
|---|---|---|---|---|
| 2006/0032758 | A1* | 2/2006 | Klocke ..... | C25D 17/001 205/220 |
| 2012/0138471 | A1* | 6/2012 | Mayer ..... | C25D 17/002 204/275.1 |
| 2019/0309436 | A1 | 10/2019 | Shimoyama et al. | |
| 2022/0106701 | A1* | 4/2022 | Tsuji ..... | C25D 17/002 |

FOREIGN PATENT DOCUMENTS

| | | | |
|---|---|---|---|
| JP | 2005-068561 | A | 3/2005 |
| JP | 2006-517004 | A | 7/2006 |
| JP | 2008-019496 | A | 1/2008 |
| JP | 2017-137519 | A | 8/2017 |
| JP | 2019-002065 | A | 1/2019 |
| KR | 2019-0017881 | A | 2/2019 |
| WO | WO 2004/020704 | A1 | 3/2004 |

* cited by examiner

PLATING APPARATUS AND PLATING PROCESS METHOD

TECHNICAL FIELD

The present invention relates to a plating apparatus and a plating process method.

BACKGROUND ART

Conventionally, there has been known what is called a cup type plating apparatus as a plating apparatus that performs a plating process on a substrate (for example, see PTL 1). Such a plating apparatus includes a plating tank that has a membrane arranged therein and has an anode arranged in an anode chamber partitioned below the membrane, and a substrate holder that is arranged above the anode chamber and holds a substrate as a cathode. Further, in such a conventional plating apparatus, the anode has a flat plate shape extending in a horizontal direction.

Note that as another prior art literature pertaining to the present invention, PTL 2 can be exemplified. In the PTL 2, a technique related to an anode mask is disclosed. Specifically, the PTL 2 discloses a plating apparatus that includes an anode mask having an opening portion through which electricity is allowed to flow between an anode and a substrate and a mechanism that changes the size of the opening portion (referred to as an opening portion variable mechanism). With such a plating apparatus, by changing the size of the opening portion of the anode mask by the opening portion variable mechanism, a forming aspect of an electric field formed between the anode and the substrate can be varied.

CITATION LIST

Patent Literature

PTL 1: Japanese Unexamined Patent Application Publication No. 2008-19496

PTL 2: Japanese Unexamined Patent Application Publication No. 2017-137519

SUMMARY OF INVENTION

Technical Problem

In the conventional cup type plating apparatus as exemplified in the above-described PTL 1, a process gas generated from the anode at the time of the plating process possibly remains on a lower surface of the membrane. In this case, plating quality of the substrate possibly deteriorates due to the process gas.

The present invention has been made in view of the above, and one of the objects of the present invention is to provide a technique that can suppress deterioration of plating quality of a substrate due to a process gas that remains on a lower surface of a membrane.

Solution to Problem

[Aspect 1] To achieve the above-described object, a plating apparatus according to one aspect of the present invention includes a plating tank and a substrate holder. The plating tank includes a membrane arranged inside the plating tank and an anode arranged in an anode chamber partitioned below the membrane. The substrate holder is arranged above the anode chamber and configured to hold a substrate as a cathode. The anode has a cylindrical shape extending in a vertical direction. The plating apparatus further includes a gas accumulation portion and a discharge mechanism. The gas accumulation portion is disposed in the anode chamber so as to have a space between the anode and the gas accumulation portion. The gas accumulation portion covers an upper end, an outer peripheral surface, and an inner peripheral surface of the anode to accumulate a process gas generated from the anode. The discharge mechanism is configured to discharge the process gas accumulated in the gas accumulation portion to outside of the plating tank.

With this aspect, the process gas generated from the cylindrically shaped anode extending in the vertical direction can be accumulated in the gas accumulation portion, and the accumulated process gas can be discharged to the outside of the plating tank by the discharge mechanism. Since this can suppress remaining of the process gas on a lower surface of the membrane, deterioration of plating quality of a substrate due to the process gas can be suppressed.

[Aspect 2] Aspect 1 described above may further include: an anode mask arranged in the anode chamber and having an opening portion through which electricity is allowed to flow between the anode and the substrate; and an anode moving mechanism that moves the anode in a vertical direction.

With this aspect, by moving the anode in the vertical direction, a forming aspect of an electric field formed between the substrate and the anode can be varied. Further, since the forming aspect of the electric field can be varied by a simple mechanism that moves the anode in the vertical direction, a structure of the plating apparatus becoming complicated can be suppressed, compared with a case where the plating apparatus includes an opening portion variable mechanism that changes the size of the opening portion of the anode mask.

[Aspect 3] In Aspect 2 described above, the anode mask may be arranged such that an upper surface of the anode mask is in contact with a lower surface of the membrane.

[Aspect 4] In Aspect 2 described above, the anode mask may be arranged such that a space is formed between an upper surface of the anode mask and a lower surface of the membrane.

[Aspect 5] In Aspect 2 described above, the plating apparatus may be configured as follows. The anode moving mechanism is connected to the anode via a first connecting member and moves the anode in a vertical direction by moving the first connecting member in the vertical direction, and the anode mask is connected to the first connecting member via a second connecting member and moves the first connecting member together with the anode when the anode moving mechanism moves the first connecting member.

[Aspect 6] To achieve the above-described object, a plating process method according to one aspect of the present invention uses a plating apparatus. The plating apparatus includes a plating tank and a substrate holder. The plating tank includes a membrane arranged inside the plating tank and an anode arranged in an anode chamber partitioned below the membrane. The substrate holder is arranged above the anode chamber and configured to hold a substrate as a cathode. The anode has a cylindrical shape extending in a vertical direction. The plating apparatus further includes a gas accumulation portion and a discharge mechanism. The gas accumulation portion is disposed in the anode chamber so as to have a space between the anode and the gas accumulation portion. The gas accumulation portion covers an upper end, an outer peripheral surface, and an inner peripheral surface of the anode accumulate a process gas generated from the anode. The discharge mechanism is configured to discharge the process gas accumulated in the gas accumulation portion to outside of the plating tank. The plating process method includes discharging the process gas accumulated in the gas accumulation portion to the outside of the plating tank by the discharge mechanism at a time of a plating process when the plating process is performed on the substrate.

With this aspect, the process gas generated from the cylindrically shaped anode extending in the vertical direction can be accumulated in the gas accumulation portion, and the accumulated process gas can be discharged to the outside of the plating tank by the discharge mechanism. This can suppress remaining of the process gas on the lower surface of the membrane in the anode chamber. As a result, the deterioration of the plating quality of the substrate due to the process gas can be suppressed.

DESCRIPTION OF EMBODIMENTS

The following will describe an embodiment of the present invention with reference to the drawings. Note that, in the following embodiment and modifications of the embodiment, identical reference signs are assigned for identical or corresponding configurations, and their descriptions may be appropriately omitted. Further, the drawings are schematically illustrated to facilitate understanding of the features of the embodiment and the modifications, and dimensional proportions and the like of each constituent element are not necessarily the same as the actual ones. Further, in some drawings, orthogonal coordinates of X-Y-Z are illustrated for reference. Of the orthogonal coordinates, the Z direction corresponds to an upper side, and the −Z direction corresponds to a lower side (direction in which gravity acts).

Figure 1:
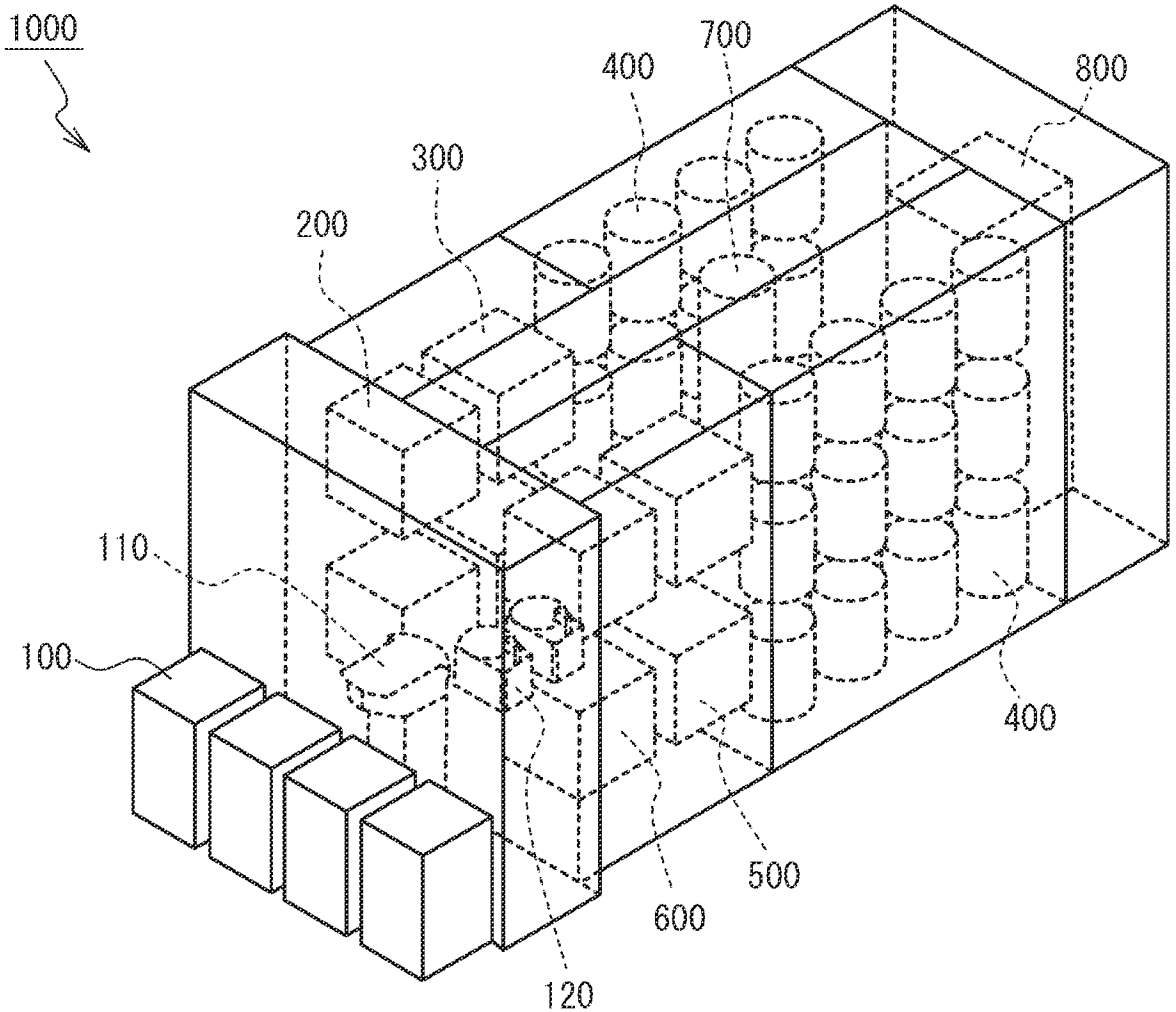
FIG. 1 is a perspective view illustrating an overall configuration of a plating apparatus of this embodiment.
Figure 2:
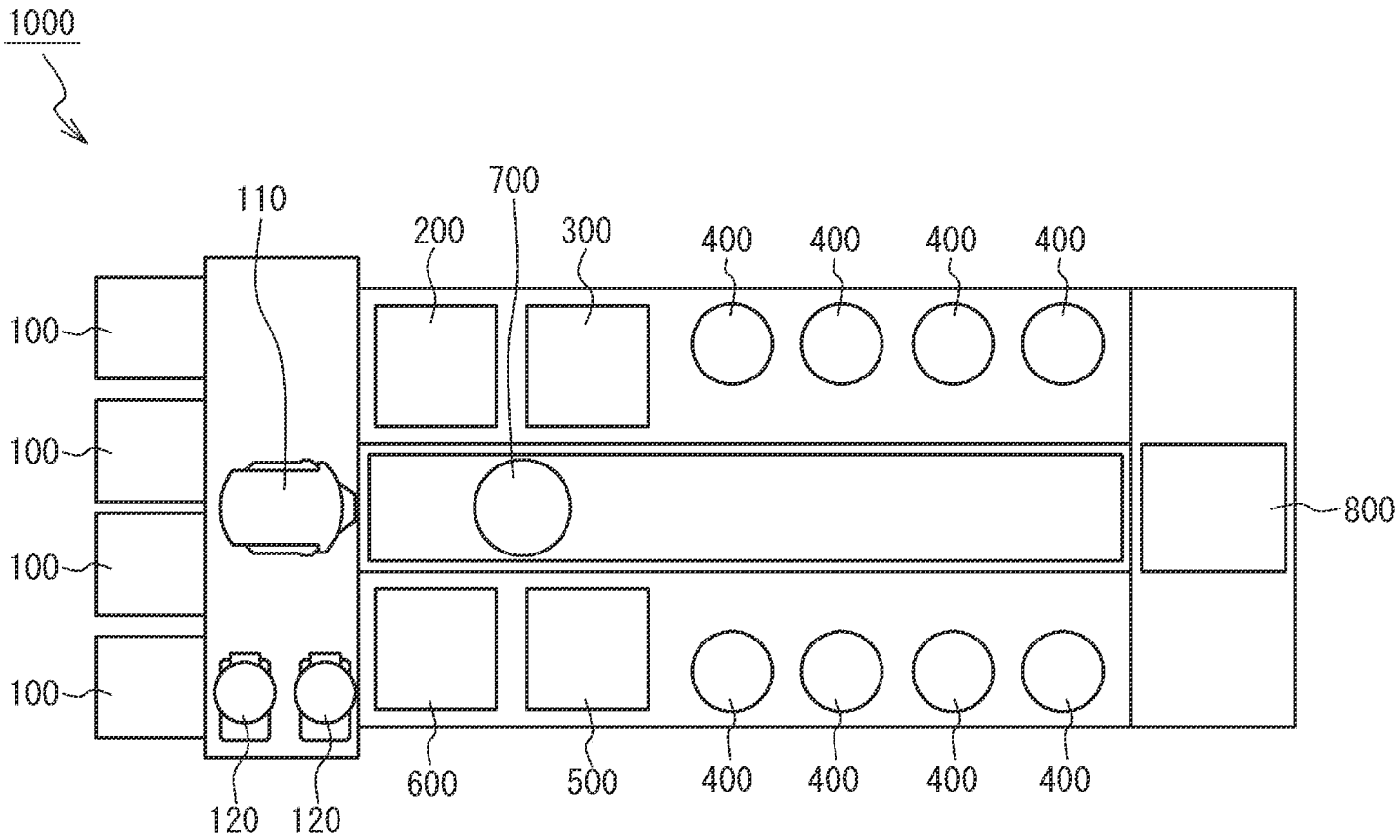
FIG. 2 is a plan view illustrating the overall configuration of the plating apparatus of this embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer or the like formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 and FIG. 2.

Subsequently, the plating modules 400 will be described. Note that, since the plurality of plating modules 400 included in the plating apparatus 1000 according to this embodiment have the identical configuration, one of the plating modules 400 will be described.

Figure 3:
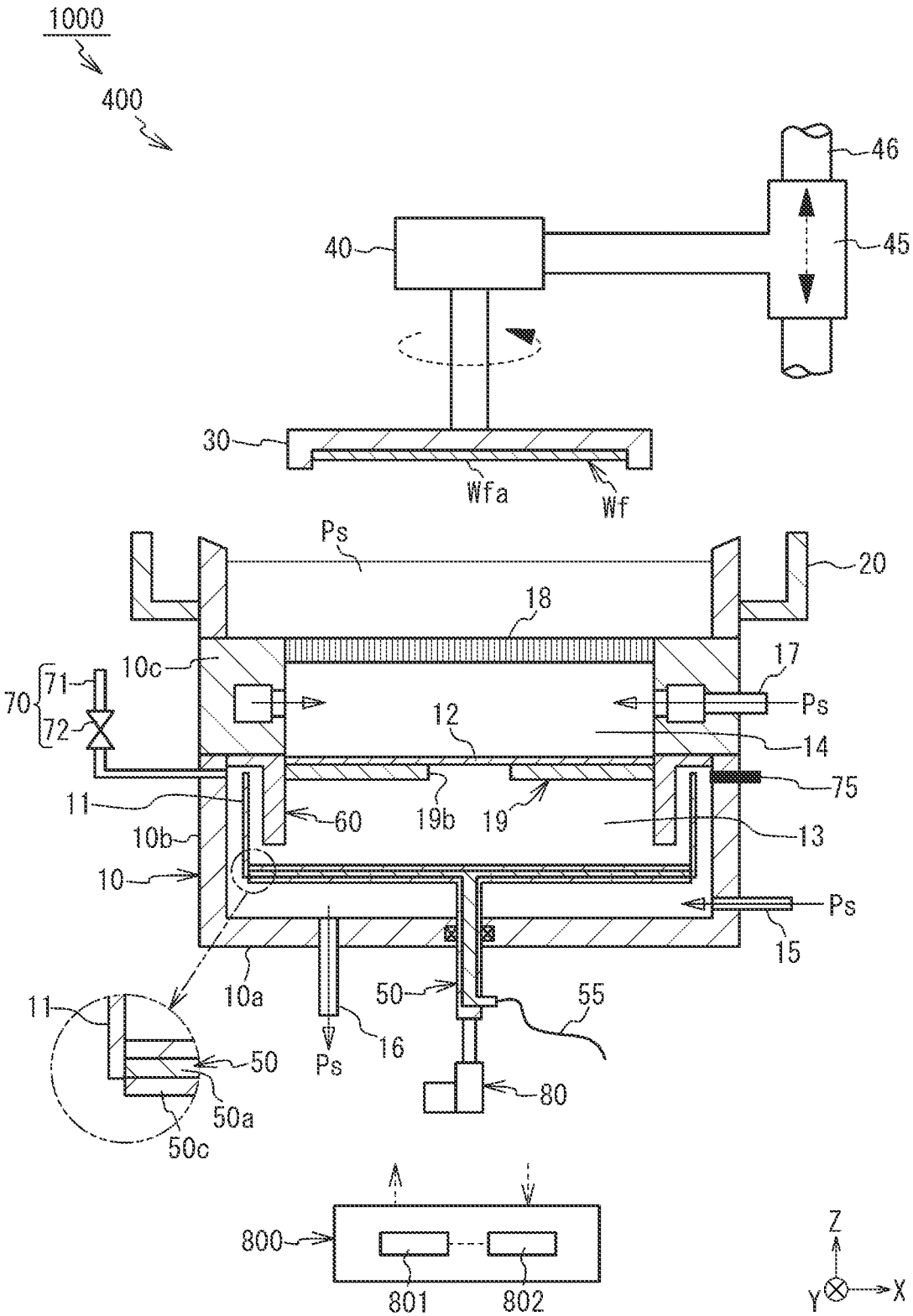
FIG. 3 is a view for describing a configuration of a plating module of this embodiment.

FIG. 3 is a view for describing the configuration of the plating module 400 of the plating apparatus 1000 of this embodiment. The plating apparatus 1000 according to this embodiment is a cup type plating apparatus. The plating module 400 of the plating apparatus 1000 according to this embodiment mainly includes a plating tank 10, an overflow tank 20, a substrate holder 30, a rotation mechanism 40, an elevating mechanism 45, a gas accumulation portion 60, a discharge mechanism 70, a level sensor 75, and an anode moving mechanism 80. Note that, in FIG. 3, cross sections of the plating tank 10, the overflow tank 20, and the substrate holder 30 are schematically illustrated.

The plating tank 10 according to this embodiment is configured of a container with a bottom having an opening on an upper side. Specifically, the plating tank 10 has a bottom wall portion 10*a* and an outer peripheral wall portion 10*b* extending upward from an outer peripheral edge of the bottom wall portion 10*a*, and an upper portion of the outer peripheral wall portion 10*b* is open. Note that, although the shape of the outer peripheral wall portion 10*b* of the plating tank 10 is not particularly limited, the outer peripheral wall portion 10*b* according to this embodiment has a cylindrical shape as an example.

In an inside of the plating tank 10, a plating solution Ps is accumulated. It is only necessary for the plating solution Ps to be a solution including an ion of a metallic element constituting a plating film, and a specific example of the plating solution Ps is not particularly limited. In this embodiment, a copper plating process is used as an example of the plating process, and a copper sulfate solution is used as an example of the plating solution Ps. Further, in this embodiment, a predetermined additive is included in the plating solution Ps. However, the configuration of the plating solution Ps is not limited to this, and the plating solution Ps can be configured not to include an additive.

Figure 4:
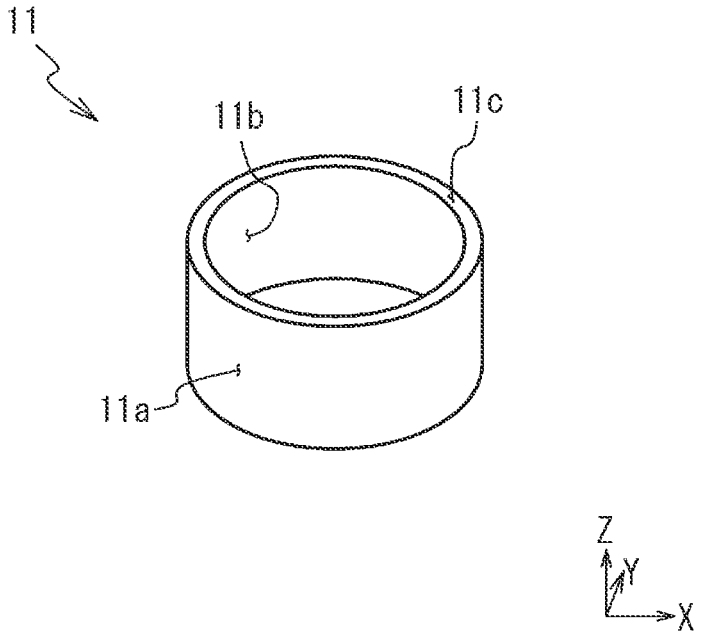
FIG. 4 is a schematic perspective view of an anode of this embodiment.

In the inside of the plating tank 10, an anode 11 is arranged. FIG. 4 is a schematic perspective view of the anode 11. With reference to FIG. 3 and FIG. 4, the anode 11 according to this embodiment has a cylindrical shape extending in the vertical direction. As illustrated in FIG. 3, the anode 11 has a lower end connected to a busbar 50 as a conductive member. The busbar 50 is electrically connected to an energization device (not illustrated) via a wiring 55. Note that a substrate Wf as a cathode is also electrically connected to the energization device via a wiring (not illustrated).

It is only necessary for a specific example of the anode 11 to generate a process gas Ga described later, and the specific example of the anode 11 is not particularly limited. However, in this embodiment, an insoluble anode is used as the specific example of the anode 11. A specific type of the insoluble anode is not particularly limited, and platinum, iridium oxide, and the like can be used.

With this embodiment, since the anode 11 has a cylindrical shape extending in the vertical direction, the process gas Ga generated from the anode 11 can be easily recovered by the gas accumulation portion 60 described later.

As illustrated in FIG. 3, in the inside of the plating tank 10, a membrane 12 is arranged above the anode 11. Specifically, the membrane 12 is arranged at a position between the anode 11 and the substrate Wf (cathode). The membrane 12 according to this embodiment has an outer peripheral portion connected to a side wall portion 60*b* of the gas accumulation portion 60 described later. Further, the membrane 12 according to this embodiment is arranged such that a surface direction of the membrane 12 becomes the horizontal direction.

The inside of the plating tank 10 is divided into two in the vertical direction by the membrane 12. A region partitioned below the membrane 12 is referred to as an anode chamber 13. A region on an upward side with respect to the membrane 12 is referred to as a cathode chamber 14. The above-described anode 11 is arranged in the anode chamber 13.

The membrane 12 is configured of a film that allows a metal ion to pass and suppresses passing of an additive included in the plating solution Ps. That is, in this embodiment, although the plating solution Ps in the cathode chamber 14 includes the additive, the plating solution Ps in the anode chamber 13 does not include the additive. However, the configuration is not limited to this, and for example, the plating solution Ps in the anode chamber 13 may also include the additive. However, even in this case, a concentration of the additive in the anode chamber 13 is lower than a concentration of the additive in the cathode chamber 14. A specific type of the membrane 12 is not particularly limited, and a known membrane can be used. To give a specific example of the membrane 12, for example, an electrolytic membrane can be used. As a specific example of the electrolytic membrane, for example, an electrolytic membrane for plating manufactured by Yuasa Membrane Systems Co., Ltd. can be used, or an ion exchange membrane and the like can be used.

By including the membrane 12 by the plating apparatus 1000 as in this embodiment, decomposition or reaction of ingredients of the additive included in the plating solution Ps can be suppressed by reaction on the anode side. This can suppress generation of an ingredient that adversely affects plating by the decomposition or reaction of the ingredients of the additive.

In the plating tank 10, a supply port for anode 15 for supplying the plating solution Ps to the anode chamber 13 is disposed. Further, in the plating tank 10, a discharge port for anode 16 for discharging the plating solution Ps in the anode chamber 13 from the anode chamber 13 is disposed. The plating solution Ps discharged from the discharge port for anode 16 is then accumulated in a reservoir tank for anode (not illustrated), and afterwards, supplied from the supply port for anode 15 to the anode chamber 13 again.

In the plating tank 10, a supply port for cathode 17 for supplying the plating solution Ps to the cathode chamber 14 is disposed. Specifically, the outer peripheral wall portion 10*b* of the plating tank 10 according to this embodiment has a part of a portion that corresponds to the cathode chamber 14 where a protrusion portion 10*c* projecting to the center side of the plating tank 10 is disposed, and the supply port for cathode 17 is disposed in the protrusion portion 10*c*.

The overflow tank 20 is configured of a container with a bottom arranged outside the plating tank 10. The overflow tank 20 is a tank disposed for accumulating the plating solution Ps exceeding an upper end of the outer peripheral wall portion 10*b* of the plating tank 10 (that is, the plating solution Ps overflowing from the plating tank 10). The plating solution Ps supplied from the supply port for cathode 17 to the cathode chamber 14 is flowed into the overflow tank 20, and afterwards, discharged from a discharge port (not illustrated) for the overflow tank 20 and accumulated in a reservoir tank for cathode (not illustrated). Afterwards, the plating solution Ps is supplied from the supply port for cathode 17 to the cathode chamber 14 again.

In the cathode chamber 14 in this embodiment, a porous ionically resistive element 18 is arranged. Specifically, the ionically resistive element 18 according to this embodiment is disposed at a position near an upper end portion of the protrusion portion 10*c*. The ionically resistive element 18 is configured of a porous plate member having a plurality of holes (pores). However, the ionically resistive element 18 is not a required configuration in this embodiment, and the plating apparatus 1000 can be configured not to include the ionically resistive element 18.

Further, in this embodiment, an anode mask 19 is arranged in the anode chamber 13. Details of the anode mask 19 will be described later.

The substrate holder 30 is a member for holding the substrate Wf as a cathode. The substrate holder 30 according to this embodiment holds the substrate Wf such that a surface to be plated Wfa of the substrate Wf faces downward. The substrate holder 30 is connected to the rotation mechanism 40. The rotation mechanism 40 is a mechanism for rotating the substrate holder 30. As the rotation mechanism 40, a known mechanism, such as a rotation motor, can be used. The rotation mechanism 40 is connected to the elevating mechanism 45. The elevating mechanism 45 is supported by a spindle 46 extending in the vertical direction. The elevating mechanism 45 is a mechanism for moving up and down the substrate holder 30 and the rotation mechanism 40 in the vertical direction. As the elevating mechanism 45, a known elevating mechanism, such as a linear motion type actuator, can be used.

When the plating process is performed, the rotation mechanism 40 rotates the substrate holder 30 while the elevating mechanism 45 moves the substrate holder 30 downward to immerse the substrate Wf in the plating solution Ps in the plating tank 10. Next, electricity flows between the anode 11 and the substrate Wf by the energization device. This forms the plating film on the surface to be plated Wfa of the substrate Wf.

The operation of the plating module 400 is controlled by the control module 800. The control module 800 includes a microcomputer, and the microcomputer includes a CPU (Central Processing Unit) 801 as a processor, a storage unit 802 as a non-transitory storage medium, and the like. In the control module 800, the CPU 801 controls operations of units to be controlled of the plating module 400 based on a command of a program stored in the storage unit 802.

Note that, in this embodiment, although one control module 800 functions as a control device that integrally controls the units to be controlled of the plating module 400, the configuration is not limited to this. For example, the control module 800 may include a plurality of control devices, and the respective plurality of control devices may individually control the respective units to be controlled of the plating module 400.

Figure 5A:
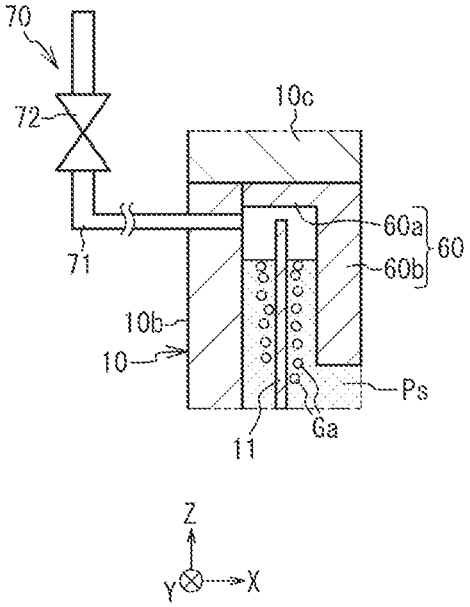
FIG. 5A and FIG. 5B are schematic cross-sectional views for describing a gas accumulation portion and a discharge mechanism of this embodiment.
Figure 5B:
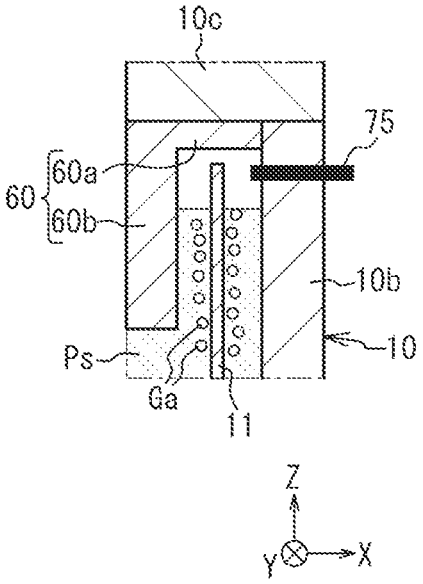

Subsequently, the gas accumulation portion 60 and the discharge mechanism 70 will be described. FIG. 5A and FIG. 5B are schematic cross-sectional views for describing the gas accumulation portion 60 and the discharge mechanism 70. Specifically, FIG. 5A schematically illustrates a cross-sectional view of a peripheral configuration of the discharge mechanism 70 in the plating tank 10 of FIG. 3, and FIG. 5B schematically illustrates a cross-sectional view of a peripheral configuration of the level sensor 75 in the plating tank 10 of FIG. 3.

Here, at the time of the plating process of the substrate Wf by the plating apparatus 1000, oxygen ($O_2$) as the process gas Ga is generated in the anode chamber 13 based on the following reaction equation.

$$2H_2O \rightarrow O_2 + 4H^+ + 4e^-$$

In a case where such a process gas Ga remains on a lower surface 12*a* of the membrane 12, the process gas Ga possibly cuts off the electric field. In this case, the plating quality of the substrate Wf possibly deteriorates. Therefore, in order to suppress remaining of the process gas Ga on the lower surface 12*a* of the membrane 12 and suppress the deterioration of the plating quality of the substrate Wf due to the process gas Ga, the plating module 400 according to this embodiment includes the gas accumulation portion 60 and the discharge mechanism 70 that are described below.

The gas accumulation portion 60 is disposed in the anode chamber 13. The gas accumulation portion 60 is configured to accumulate the process gas Ga generated from the anode 11. Specifically, the gas accumulation portion 60 according to this embodiment is disposed in the anode chamber 13 so as to have a space between the cylindrically shaped anode 11 and the gas accumulation portion 60 to cover an upper end 11*c*, an outer peripheral surface 11*a*, and an inner peripheral surface 11*b* (see FIG. 4 for the reference signs) of the anode 11.

More specifically, the gas accumulation portion 60 according to this embodiment has an upper wall portion 60*a* and the side wall portion 60*b*. The upper wall portion 60*a* is a portion that is connected to the outer peripheral wall portion 10*b* of the plating tank 10 and arranged above the upper end 11*c* of the anode 11. The side wall portion 60*b* is a portion configured to have an upper end portion connected to the upper wall portion 60*a* and extend downward from the upper wall portion 60*a*. Note that the upper wall portion 60*a* according to this embodiment has a ring shape (or a flange shape) and the side wall portion 60*b* has a cylindrical shape. The process gas Ga generated from the anode 11 is accumulated in a region partitioned by the outer peripheral wall portion 10*b* of the plating tank 10 and the upper wall portion 60*a* and the side wall portion 60*b* of the gas accumulation portion 60.

With reference to FIG. 5A, the discharge mechanism 70 is a mechanism configured to discharge the process gas Ga accumulated in the gas accumulation portion 60 to an outside of the plating tank 10. Specifically, the discharge mechanism 70 according to this embodiment includes a discharge pipe 71 and an open/close valve 72 arranged in the discharge pipe 71. The discharge pipe 71 communicates between the gas accumulation portion 60 and the outside of the plating tank 10. An opening and closing operation of the open/close valve 72 is controlled by the control module 800. The open/close valve 72 is usually in a valve-closed state. When the open/close valve 72 becomes in a valve-opening state, the process gas Ga in the gas accumulation portion 60 passes through the discharge pipe 71 and is discharged to the outside of the plating tank 10 (specifically, into the atmosphere).

With reference to FIG. 5B, the level sensor 75 is a sensor for detecting a position (height) of a liquid surface of the plating solution Ps in the gas accumulation portion 60. The level sensor 75 transmits its detection result to the control module 800. In a case where the process gas Ga does not exist in the gas accumulation portion 60, the gas accumulation portion 60 is filled with the plating solution Ps. When the process gas Ga is accumulated in the gas accumulation portion 60, the liquid surface of the plating solution Ps in the gas accumulation portion 60 drops. Thus, the liquid surface of the plating solution Ps in the gas accumulation portion 60 has a correlation with an amount of the process gas Ga accumulated in the gas accumulation portion 60. Therefore, the control module 800 according to this embodiment controls the discharge mechanism 70 based on the detection result of the level sensor 75. The control of the discharge mechanism 70 by the control module 800 will be described as follows by referring to a flowchart.

Figure 6:
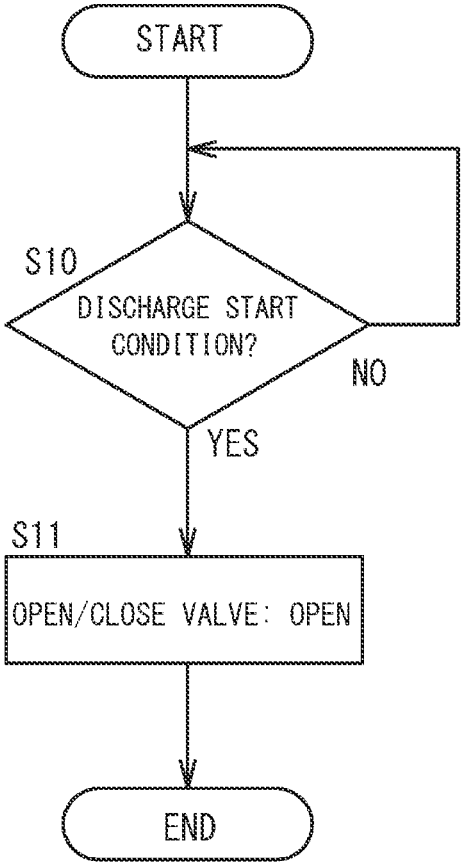
FIG. 6 is an example of a flowchart of a control of the discharge mechanism of this embodiment.

FIG. 6 is an example of the flowchart of the control of the discharge mechanism 70 by the control module 800 according to this embodiment. In a step S10, the control module 800 determines whether or not a "discharge start condition" is satisfied. The "discharge start condition" is a condition for starting to discharge the process gas Ga in the gas accumulation portion 60.

Specifically, in the step S10, the control module 800 determines whether or not the liquid surface of the plating solution Ps in the gas accumulation portion 60 has come to a lower position with respect to a predetermined reference position based on the detection result of the level sensor 75. In a case where the control module 800 determines that the liquid surface of the plating solution Ps has come to a lower position with respect to the reference position, the control module 800 determines that the discharge start condition is satisfied (YES).

In a case where YES is determined in the step S10, the control module 800 causes the open/close valve 72 to open (step S11). This discharges the process gas Ga in the gas accumulation portion 60 to the outside of the plating tank 10.

Note that, in a case where the control module 800 determines that the liquid surface of the plating solution Ps in the gas accumulation portion 60 has come to the reference position or to an upper position with respect to the reference position based on the detection result of the level sensor 75 after the open/close valve 72 is opened once, the control module 800 has only to return the open/close valve 72 to the valve-closed state. Alternatively, the control module 800 may return the open/close valve 72 to the valve-closed state after a preset predetermined time has elapsed since the open/close valve 72 was opened (that is, in this case, the open/close valve 72 becomes in the valve-opening state for the predetermined time).

With this embodiment described above, the process gas Ga generated from the cylindrically shaped anode 11 extending in the vertical direction can be accumulated in the gas accumulation portion 60, and the process gas Ga accumulated in the gas accumulation portion 60 can be discharged to the outside of the plating tank 10 by the discharge mechanism 70. This can suppress remaining of the process gas Ga on the lower surface 12*a* of the membrane 12 in the anode chamber 13. As a result, the deterioration of the plating quality of the substrate Wf due to the process gas Ga can be suppressed.

Figure 7A:
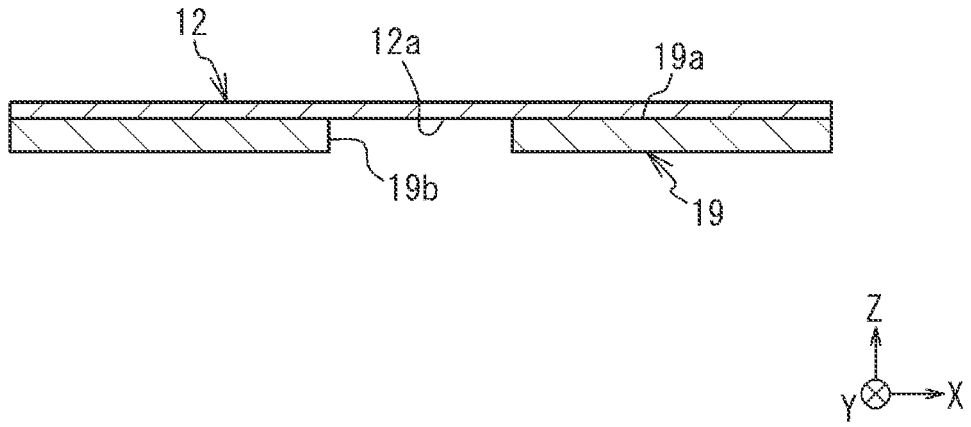
FIG. 7A is a schematic cross-sectional view of a membrane and an anode mask of this embodiment.
Figure 7B:
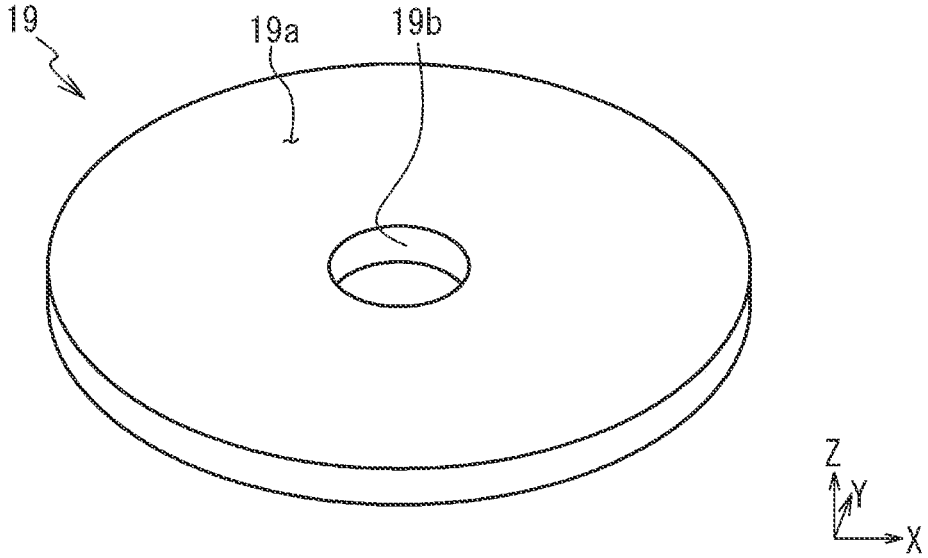
FIG. 7B is a schematic perspective view of the anode mask of this embodiment.

Subsequently, the anode mask 19 will be described. FIG. 7A is a schematic cross-sectional view of the membrane 12 and the anode mask 19. FIG. 7B is a schematic perspective view of the anode mask 19. With reference to FIG. 3, FIG. 7A, and FIG. 7B, the anode mask 19 is arranged in the anode chamber 13. The anode mask 19 according to this embodiment has a ring shape. The anode mask 19 has an opening portion 19*b* through which the electricity is allowed to flow between the anode 11 and the substrate Wf in this embodiment, a radial dimension (diameter) of the opening portion 19*b* is smaller than an inner diameter of the anode 11. Further, as illustrated in FIG. 7A, the anode mask 19 according to this embodiment is arranged such that an upper surface 19*a* of the anode mask 19 is in contact with the lower surface 12*a* of the membrane 12.

Figure 8:
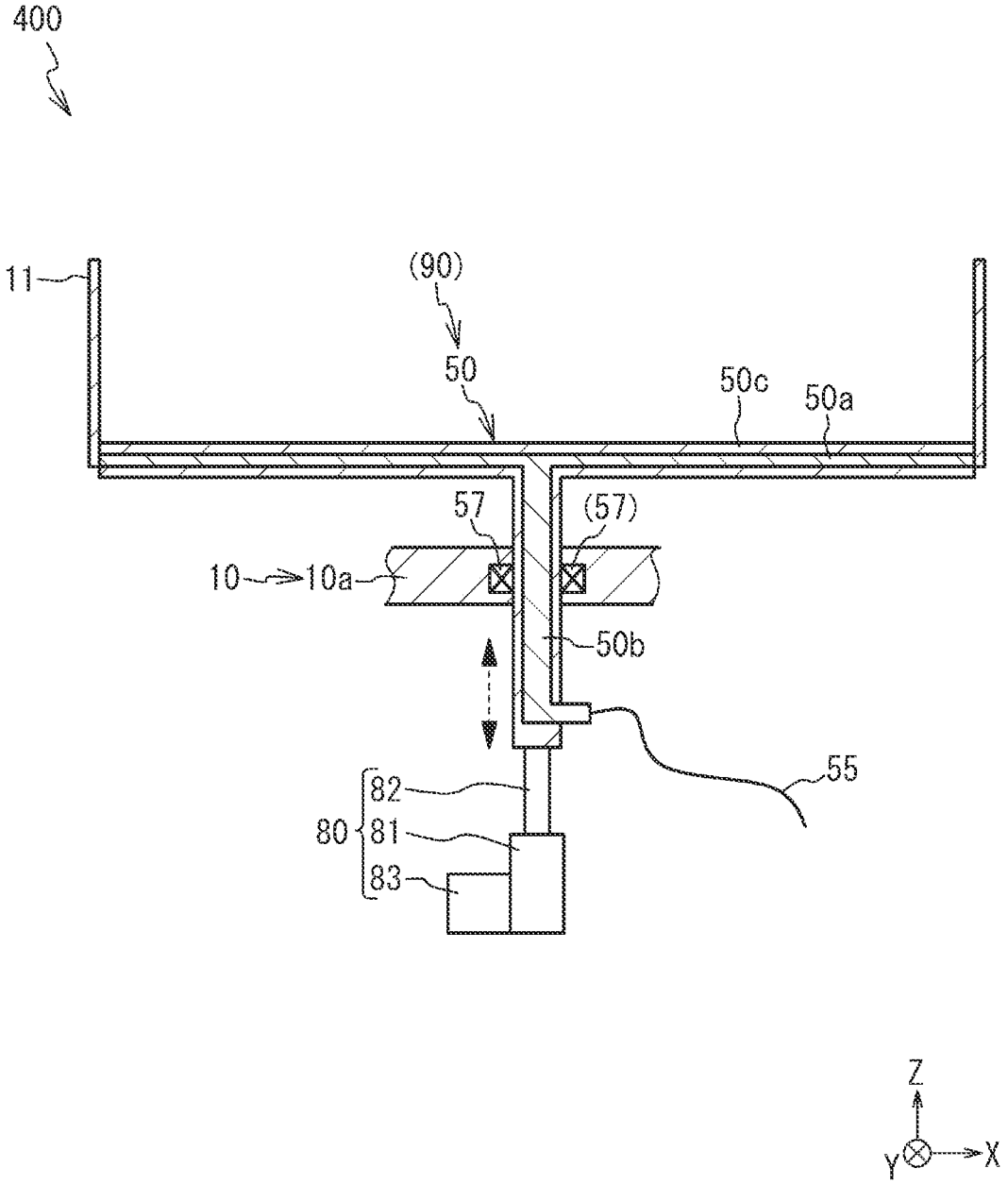
FIG. 8 is a cross-sectional view schematically illustrating a peripheral configuration of an anode moving mechanism in the plating module of this embodiment.

Subsequently, the anode moving mechanism 80 will be described. FIG. 8 is a cross-sectional view schematically illustrating a peripheral configuration of the anode moving mechanism 80 in the plating module 400. The anode moving mechanism 80 is a mechanism for moving the anode 11 in the vertical direction. Specifically, the anode moving mechanism 80 according to this embodiment is connected to the anode 11 via the busbar 50.

That is, the busbar 50 according to this embodiment is an example of a "first connecting member 90" that connects the anode moving mechanism 80 with the anode 11. By moving the busbar 50 as the first connecting member 90 in the vertical direction, the anode moving mechanism 80 according to this embodiment moves the anode 11 in the vertical direction.

Note that the busbar 50 according to this embodiment includes a rod-shaped portion 50*b* extending in the vertical direction and a flat plate portion 50*a* that is connected to an upper end of the rod-shaped portion 50*b* and extends in the horizontal direction. The flat plate portion 50*a* has an outer peripheral edge connected to a lower end of the anode 11. The flat plate portion 50*a* and the rod-shaped portion 50*b* are configured of a conductive material. Further, the busbar 50 according to this embodiment also includes a coating material 50*c* that coats the flat plate portion 50*a* and the rod-shaped portion 50*b*. Although a specific material of the coating material 50*c* is not particularly limited, in this embodiment, a resin, such as polytetrafluoroethylene and polyetheretherketone, is used as an example.

Although it is only necessary for the anode moving mechanism 80 to be able to move the anode 11 in the vertical direction and a specific configuration of the anode moving mechanism 80 is not particularly limited, the anode moving mechanism 80 according to this embodiment is configured of a piston and cylinder mechanism as an example. Specifically, the anode moving mechanism 80 according to this embodiment includes a cylinder 81, a piston 82 that goes in and out of the cylinder 81 while sliding relative to the cylinder 81, and an actuator 83 that drives the piston 82. The operation of the actuator 83 is controlled by the control module 800. Further, the anode moving mechanism 80 is arranged such that the piston 82 is displaced in the vertical direction.

The piston 82 has an upper end connected to the rod-shaped portion 50*b* (specifically, the coating material 50*c* that covers a peripheral area of the rod-shaped portion 50*b*) of the busbar 50. By displacing the piston 82 upward by the actuator 83 in response to a command of the control module 800, the busbar 50 moves upward, and this causes the anode 11 also to move upward. On the other hand, by displacing the piston 82 downward by the actuator 83 in response to a command of the control module 800, the busbar 50 moves downward, and this causes the anode 11 also to move downward.

Note that a through-hole for allowing the rod-shaped portion 50*b* of the busbar 50 to pass through is provided in the bottom wall portion 10*a* of the plating tank 10, and a sealing member 57 is disposed on an inner peripheral surface of the through-hole. The sealing member 57 effectively suppresses leakage of the plating solution Ps in the anode chamber 13 to the outside from the through-hole.

Figure 9A:
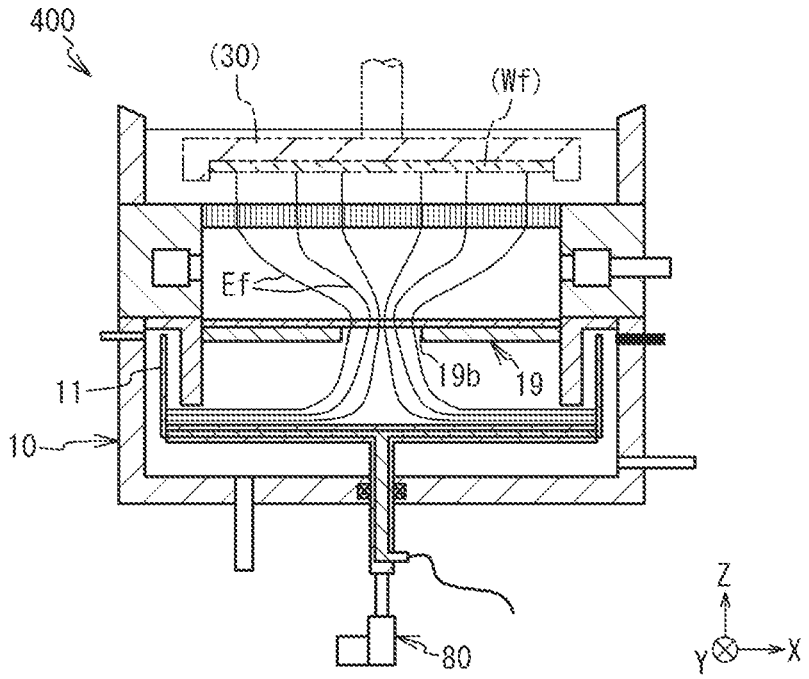
FIG. 9A and FIG. 9B are schematic cross-sectional views illustrating variations of a forming aspect of an electric field in a case where a position in a vertical direction of the anode of this embodiment varies.
Figure 9B:
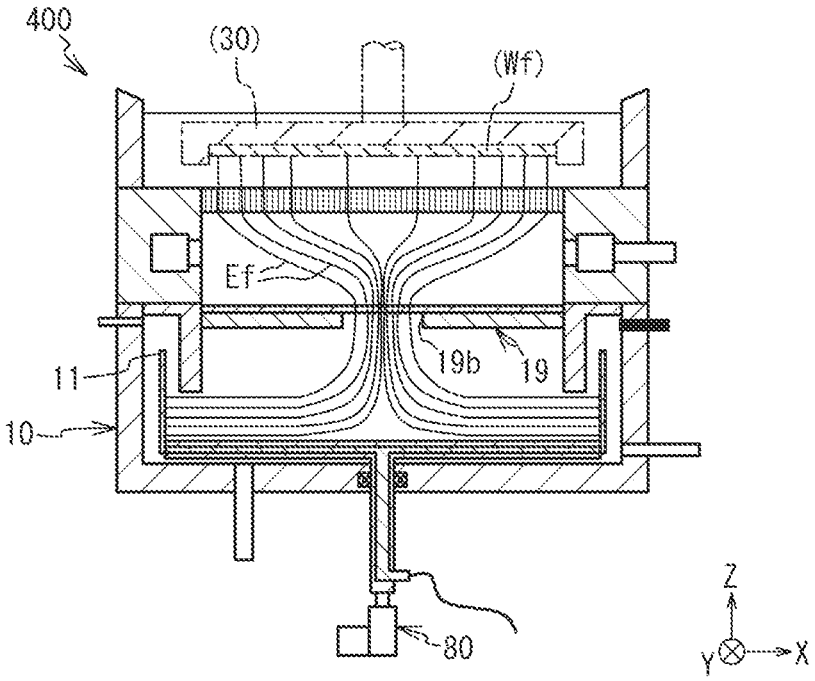

FIG. 9A and FIG. 9B are schematic cross-sectional views illustrating variations of a forming aspect of the electric field in a case where the position in the vertical direction of the anode 11 varies. Specifically, FIG. 9A schematically illustrates a cross-sectional view of a state where the anode 11 is positioned upward compared with FIG. 9B at the time of the plating process, and FIG. 9B schematically illustrates a cross-sectional view of a state where the anode 11 is positioned downward compared with FIG. 9A at the time of the plating process. "Ef" illustrated in FIG. 9A and FIG. 9B indicates a line of electric force.

As illustrated in FIG. 9A and FIG. 9B, by moving the anode 11 upward and downward by the anode moving mechanism 80, a distance between the substrate Wf and the anode 11 can be changed. This can vary the forming aspect of the electric field formed between the substrate Wf and the anode 11 at the time of plating process.

Further, with this embodiment, since the forming aspect of the electric field can be varied with a simple mechanism that moves the anode 11 in the vertical direction by the anode moving mechanism 80, a structure of the plating apparatus 1000 becoming complicated can be suppressed, for example, compared with a case where the plating apparatus 1000 includes an opening portion variable mechanism that changes the size of the opening portion 19*b*. This can ensure reduction of the cost of the plating apparatus 1000.

Note that, in the case of this embodiment, as the anode 11 moves downward, a density of the line of electric force Ef that passes through the opening portion 19*b* of the anode mask 19 increases. In view of this, in a case where the density of the line of electric force Ef that passes through the opening portion 19*b* of the anode mask 19 is desirably increased, the anode 11 may be moved downward. Conversely, in a case where the density of the line of electric force Ef that passes through the opening portion 19*b* is desirably decreased, the anode 11 may be moved upward.

Note that a plating process method according to this embodiment is achieved by the above-described plating apparatus 1000. Accordingly, in order to omit overlapping description, detailed description of the plating process method is omitted.

[Modification 1] In the above-described embodiment, although the anode mask 19 is arranged such that the upper surface 19*a* of the anode mask 19 is in contact with the lower surface 12*a* of the membrane 12 (FIG. 7A), the configuration is not limited to this. For example, the anode mask 19 may be arranged in a position as below.

Figure 10A:
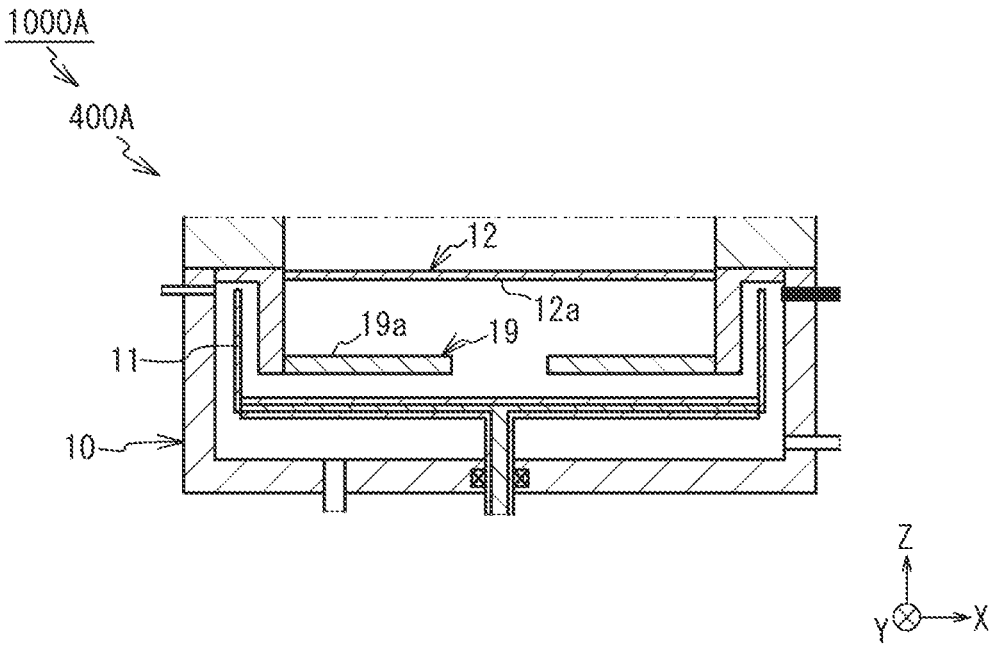
FIG. 10A is a schematic cross-sectional view illustrating a peripheral configuration of an anode mask of a plating apparatus according to a modification 1 of this embodiment.

FIG. 10A is a schematic cross-sectional view illustrating a peripheral configuration of the anode mask 19 in a plating module 400A of a plating apparatus 1000A according to the modification 1 of this embodiment. The anode mask 19 according to this modification is arranged in a position such that the upper surface 19*a* of the anode mask 19 is not in contact with the lower surface 12*a* of the membrane 12 and a space is formed between the upper surface 19*a* of the anode mask 19 and the lower surface 12*a* of the membrane 12. Even in this modification, an operational advantage similar to the embodiment described above can be provided.

Figure 10B:
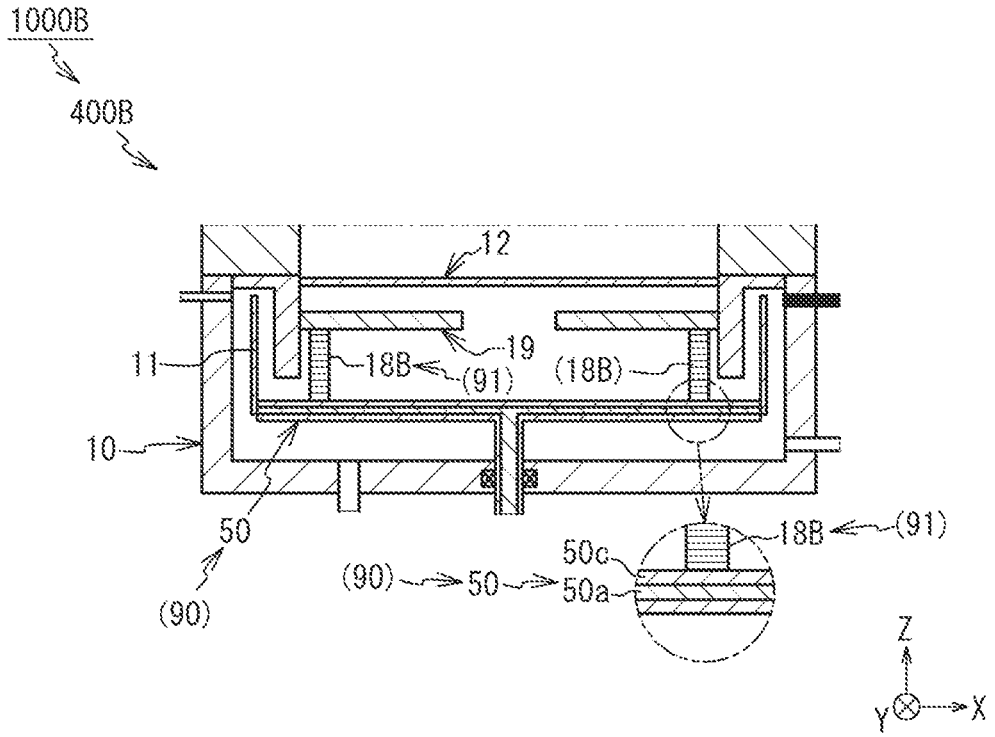
FIG. 10B is a schematic cross-sectional view illustrating a peripheral configuration of an anode mask of a plating apparatus according to a modification 2 of this embodiment.

[Modification 2] FIG. 10B is a schematic cross-sectional view illustrating a peripheral configuration of the anode mask 19 in a plating module 400B of a plating apparatus 1000B according to the modification 2 of this embodiment. The plating module 400B according to this modification is different from the above-described plating module 400 and the plating module 400A mainly in the respect of further including a second connecting member 91.

The second connecting member 91 is a member for connecting the anode mask 19 with the first connecting member 90 (busbar 50 in this modification). This allows the anode mask 19 according to this modification to move in the vertical direction together with the anode 11 in a case where the anode moving mechanism 80 moves the first connecting member 90 in the vertical direction in order to move the anode 11 in the vertical direction.

Although a specific example of the second connecting member 91 is not particularly limited, in this modification, a second ionically resistive element 18B is used as an example of the second connecting member 91. Specifically, the second ionically resistive element 18B is configured of a porous member similar to the ionically resistive element 18. Further, the second ionically resistive element 18B is arranged in a region inside in a radial direction (radial direction of the anode 11) with respect to the anode 11 in the anode chamber 13. Further, the second ionically resistive element 18B has a cylindrical shape. Then, the second ionically resistive element 18B has an upper end connected to the anode mask 19, and the second ionically resistive element 18B has a lower end connected to the coating material 50*c* that covers the surface of the flat plate portion 50*a* of the busbar 50.

Even in this modification, an operational advantage similar to the embodiment described above can be provided. Further, with this modification, the anode mask 19 can be moved in the vertical direction together with the anode 11.

Although the embodiment and modifications according to the present invention have been described in detail above, the present invention is not limited to such specific embodiment and modifications, and further various kinds of variants and modifications are possible within the scope of the gist of the present invention described in the claims.

REFERENCE SIGNS LIST

10 . . . plating tank
11 . . . anode
11*a* . . . outer peripheral surface
11*b* . . . inner peripheral surface
11*c* . . . upper end
12 . . . membrane
12*a* . . . lower surface
13 . . . anode chamber
19 . . . anode mask
19*a* . . . upper surface
19*b* . . . opening portion
30 . . . substrate holder
60 . . . gas accumulation portion
70 . . . discharge mechanism
80 . . . anode moving mechanism
90 . . . first connecting member
91 . . . second connecting member
400 . . . plating module
1000 . . . plating apparatus
Wf . . . substrate
Wfa . . . surface to be plated
Ps . . . plating solution
Ef . . . line of electric force
Ga . . . process gas

The invention claimed is:

1. A plating apparatus comprising:

a plating tank that includes a membrane arranged inside the plating tank, and an anode that has a cylindrical shape extending in a vertical direction and is arranged in an anode chamber partitioned below the membrane;

a substrate holder arranged above the anode chamber and configured to hold a substrate as a cathode, a gas accumulation portion disposed in the anode chamber so as to have a space between the anode and the gas accumulation portion, the gas accumulation portion covering an upper end, an outer peripheral surface, and an inner peripheral surface of the anode to accumulate a process gas generated from the anode;

a discharge mechanism configured to discharge the process gas accumulated in the gas accumulation portion to outside of the plating tank;

an anode mask arranged in the anode chamber and having an opening portion through which electricity is allowed to flow between the anode and the substrate; and an anode moving mechanism that moves the anode in a vertical direction.

2. The plating apparatus according to claim 1, wherein the anode mask is arranged such that an upper surface of the anode mask is in contact with a lower surface of the membrane.

3. The plating apparatus according to claim 1, wherein the anode mask is arranged such that a space is formed between an upper surface of the anode mask and a lower surface of the membrane.

4. The plating apparatus according to claim 1, wherein the anode moving mechanism is connected to the anode via a first connecting member and moves the anode in a vertical direction by moving the first connecting member in the vertical direction, and the anode mask is connected to the first connecting member via a second connecting member and moves the first connecting member together with the anode when the anode moving mechanism moves the first connecting member.

5. A plating process method using a plating apparatus, wherein the plating apparatus includes:

a plating tank that includes a membrane arranged inside the plating tank, and an anode that has a cylindrical shape extending in a vertical direction and is arranged in an anode chamber partitioned below the membrane;

a substrate holder arranged above the anode chamber and configured to hold a substrate as a cathode, a gas accumulation portion disposed in the anode chamber so as to have a space between the anode and the gas accumulation portion, the gas accumulation portion covering an upper end, an outer peripheral surface, and an inner peripheral surface of the anode to accumulate a process gas generated from the anode; and a discharge mechanism configured to discharge the process gas accumulated in the gas accumulation portion to outside of the plating tank, an anode mask arranged in the anode chamber and having an opening portion through which electricity is allowed to flow between the anode and the substrate; and an anode moving mechanism that moves the anode in a vertical direction; and the plating process method comprises discharging the process gas accumulated in the gas accumulation portion to the outside of the plating tank by the discharge mechanism at a time of a plating process when the plating process is performed on the substrate.

6. A plating apparatus comprising:

a plating tank that includes a membrane arranged inside the plating tank, and an anode that has a cylindrical shape extending in a vertical direction and is arranged in an anode chamber partitioned below the membrane;

a substrate holder arranged above the anode chamber and configured to hold a substrate as a cathode, a gas accumulation portion disposed in the anode chamber so as to have a space between the anode and the gas accumulation portion, the gas accumulation portion covering an upper end, an outer peripheral surface, and an inner peripheral surface of the anode to accumulate a process gas generated from the anode; and a discharge mechanism configured to discharge the process gas accumulated in the gas accumulation portion to outside of the plating tank; wherein the discharge mechanism comprises a level sensor for detecting a position of a liquid level of a plating solution in the gas accumulation portion, a discharge pipe connected to the gas accumulation portion, an open/close valve arranged in the discharge pipe, and a control module configured to control the open/close valve based on a detection result of the level sensor.

7. The plating apparatus according to claim 6, wherein the control module is configured to open the open/close valve when the liquid surface of the plating solution in the gas accumulation portion is determined to be under a predetermined reference position based on the detection result of the level sensor, and to close the open/close valve when the liquid surface of the plating solution in the gas accumulation portion is determined to be at the reference position or above the reference position based on the detection result of the level sensor.

8. The plating apparatus according to claim 6, wherein the control module is configured to open the open/close valve when the liquid surface of the plating solution in the gas reservoir is determined to be under a predetermined reference position based on the detection result of the level sensor, and to close the open/close valve after a predetermined time has elapsed since the open/close valve was opened.

9. The plating apparatus according to claim 6, further comprising:

an anode mask arranged in the anode chamber and having an opening portion through which electricity is allowed to flow between the anode and the substrate.

10. The plating apparatus according to claim 9, wherein the anode mask is arranged such that an upper surface of the anode mask is in contact with a lower surface of the membrane.

11. The plating apparatus according to claim 9, wherein the anode mask is arranged such that a space is formed between an upper surface of the anode mask and a lower surface of the membrane.

* * * * *